US008338068B2

(12) United States Patent
Bossidan et al.

(10) Patent No.: US 8,338,068 B2
(45) Date of Patent: Dec. 25, 2012

(54) BLACK TONER PARTICLES AND PRINTING METHODS

(75) Inventors: Becky Bossidan, Rehovot (IL); Haim Gal Victor, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 894 days.

(21) Appl. No.: 10/575,293

(22) PCT Filed: Oct. 29, 2003

(86) PCT No.: PCT/IL03/00891

§ 371 (c)(1),
(2), (4) Date: Apr. 12, 2006

(87) PCT Pub. No.: WO2005/040934

PCT Pub. Date: May 6, 2005

(65) Prior Publication Data

US 2007/0020545 A1 Jan. 25, 2007

(51) Int. Cl.
*G03G 9/12* (2006.01)

(52) U.S. Cl. ..... 430/114; 430/115

(58) Field of Classification Search ..... 430/108.21, 430/108.9, 115, 123.5, 119.1, 109.3, 118.6, 430/114

See application file for complete search history.

(56) References Cited

U.S. PATENT DOCUMENTS

| | | | | |
|---|---|---|---|---|
| 3,890,240 | A | 6/1975 | Hochberg | |
| 4,455,361 | A | 6/1984 | Narusawa et al. | |
| 5,304,451 | A * | 4/1994 | Felder et al. | 430/137.22 |
| 5,538,828 | A * | 7/1996 | Suzuki et al. | 430/109.3 |
| 6,120,959 | A | 9/2000 | Sugizaki et al. | |

FOREIGN PATENT DOCUMENTS

| | | | |
|---|---|---|---|
| EP | 0671664 | | 9/1995 |
| GB | 2370580 | A * | 7/2002 |
| JP | 55-022719 | | 2/1980 |
| JP | 1254968 | | 10/1989 |
| JP | 01254968 | A * | 10/1989 |
| WO | WO2005040934 | | 5/2005 |

OTHER PUBLICATIONS

Chemical Abstracts Registry # 147-14-8 (2008).*
JPO Abstract of 01-254968 (Oct. 1989).*
Diamond, Arthur S & David Weiss (eds.) Handbook of Imaging Materials, 2nd ed.. New York: Marcel-Dekker, Inc. (Nov. 2001) pp. 242-247 & 254-257.*
Diamond, Arthur S & David Weiss (eds.) Handbook of Imaging Materials, 2nd ed.. New York: Marcel-Dekker, Inc. (Nov. 2001) pp. 145-164.*
Chemical Abstracts Registry # 147-14-8, 2008.

* cited by examiner

*Primary Examiner* — Christopher Rodee

(57) ABSTRACT

A black toner particle for use in a printing toner, the particle comprising:
a polymer:
carbon black; and
a plurality of different colored pigments;
wherein the carbon black and pigments are dispersed in the polymer.

21 Claims, No Drawings

BLACK TONER PARTICLES AND PRINTING METHODS

RELATED APPLICATION DATA

The present application is a national stage application claiming priority to PCT Application PCT/IL2003/000891 having a filing date of Oct. 29, 2003 entitled "Black Toner."

FIELD OF THE INVENTION

The present invention relates to black toners used in printing and, optionally, to the neutrality of printed black provided by such black toners and/or their resistance to fading with time.

BACKGROUND OF THE INVENTION

An image printed by a printing press using toner is typically printed using a set of toners, comprising Cyan, Magenta, Yellow and optionally Black toners, commonly referred to as CMYK. Whereas black can theoretically be printed on a region of a printing substrate such as paper or transparent film by printing C, M and Y toners, blacks are often printed using a dedicated black toner, as a blacker black that requires less toner can generally be printed using a relatively inexpensive dedicated black toner rather than by printing a combination of C, M and Y toners.

Several types of toner are known, for example, powder toners, comprising from electrically charged pigmented particles in a powder form or liquid toners in which electrically charged pigmented toner particles are dispersed in a liquid carrier. In black toners carbon black is generally used to provide the black pigment of toner particles. However, blacks printed using toners comprising toner particles having only carbon black pigments are generally not completely neutral and may often evidence a degree of blue or brown tint. In addition, they have a tendency to fade and may develop a non-neutral hue with time. The eye is exceptionally sensitive to shades of gray and fading or drifts from a zero hue of printed blacks and grays as a result of exposure to light often affect quality of a printed image to a greater extent than fading of printed C, M or Y. In black liquid toners, in order to offset undesirable tint and moderate fading and drift from neutrality as a result of exposure; a colored pigment in addition to carbon black is often added to the toner.

UK Patent Application GB 2370 580 published on Jul. 3, 2002, the disclosure of which is incorporated herein by reference, describes black and gray inks for ink jet printing that comprise a carbon black; a phthalocyanine pigment (C.I. Pigment Blue 15.3 or 15.4); a dioxazine violet pigment (e.g. C.I. Pigment Violet 23); and an aqueous carrier medium. The application provides evidence that blacks and grays printed using the inks are freer from color tint than blacks and grays printed using prior art control inks. However, the inks are considerably less color neutral than black liquid toners known in the art. An example of one of the inks described in the application has CIELAB L*a*b* colorimetry values equal respectively to 21.7, 0.71 and 2.46 and an example of another of the inks has L*a*b* values equal to 52.3, 0.4 and 1.42. The application claims the inks show excellent light fastness but does not provide quantitative measures of the light fastness of the inks.

SUMMARY OF THE INVENTION

An aspect of some embodiments of the invention is to provide black toner particles comprising carbon black and at least two color pigments dispersed in a polymer. In an embodiment of the invention, the black toner has improved light fastness and/or improved color neutrality.

The function of the color pigments is to balance the off-black components of the carbon black. The use of more than one such pigment allows for the possibility of choosing color fast pigments, each of which is not suitable, by itself, for offsetting the off-black condition of the carbon black.

While two colored pigments (in addition to carbon black) have been used in prior art ink-jet ink, the results have been relatively poor, as to initial blackness and do not indicate that this method would be useful for polymer toner particles. The present inventors have found, surprisingly, that when used in polymer based toner particles, the results are far superior to those achievable with ink jet, so that a black toner having both good initial color neutrality and good color fastness is possible. It is noted that having both these factors is an important goal for photographic digital printing.

In accordance with an embodiment of the invention the color pigments comprise a light-fast blue pigments and a light-fast violet pigment. In an embodiment of the invention the black liquid toner has a chroma (C) value lower than, but close to that of a comparative prior art black liquid toner and, as indicated by its a* b* values ($C=\{(a^*)^2+(b^*)^2\}^{1/2}$), about a same degree of neutrality as a comparative prior art liquid toner. However, it has a substantially lower L* value and improved neutrality than reported for inkjet inks comprising carbon black, blue and violet pigments, such as those described in UK Patent Application GB 2370 580 cited above. There is thus provided, in accordance with an embodiment of the invention, a black toner particle for use in a printing toner, the particle comprising:

a polymer:

carbon black; and a plurality of different colored pigments;

wherein the carbon black and pigments are dispersed in the polymer.

In an embodiment of the invention, the plurality of colored pigments comprises two colored pigments. Alternatively, the plurality of colored pigments comprises three or more colored pigments.

In an embodiment of the invention, one of the colored pigments is a blue pigment, optionally, having a color index pigment blue 15.3. Optionally, the blue pigment has a color index pigment blue 15.4. Optionally, the blue pigment is a Phthalocyanine pigment.

In an embodiment of the invention, one of the colored pigments is a violet pigment. Optionally, the violet pigment has a color index pigment violet 23. Optionally, the violet pigment is a Dioxazine pigment.

In an embodiment of the invention, the carbon black and different colored pigments provide the toner particle with a Chroma value having magnitude less than about 2 optionally less than 1.5 or less than 1, after printing on white paper.

In an embodiment of the invention, the polymer is a copolymer of ethylene and met acrylic acid. In an embodiment of the invention, the carbon black is Nipex 150.

There is further provided, in accordance with an embodiment of the invention, a black liquid toner comprising toner particles in accordance with an embodiment of the invention dispersed in a carrier liquid. Optionally, the toner includes a charge director.

There is further provided, in accordance with an embodiment of the invention, a black powder toner comprising toner particles in accordance with an embodiment of the invention.

There is further provided, in accordance with an embodiment of the invention, a method of printing an image on a substrate comprising:

generating a charge distribution responsive to the image on a surface, the charge distribution defining image areas and background areas;

adhering toner particles comprised in a toner in accordance with an embodiment of the invention, to image areas on the surface; and transferring the toner particles from the surface to the substrate.

DETAILED DESCRIPTION OF EXEMPLARY EMBODIMENTS

Black liquid toner in accordance with an embodiment of the present invention has toner particles comprising polymer particles in which carbon black and at least two colored pigments are dispersed. In an embodiment of the invention, the at least two color pigments comprise a light fast blue pigment and a violet pigment. Optionally, the carbon black is Nipex 150 manufactured by Degussa, the blue pigment is Heliogen Blue 7086 manufactured by BASF and the violet pigment is Hostaperm Violet P-RL manufactured by Claraint. The carbon black and blue and violet pigments are mixed with a slurry of plasticized polymer particles solvated with a carrier liquid, such as for example Isopar L manufactured by Exxon, to provide the black liquid toner. The black liquid toner not only has improved light fastness but is relatively free of vacancy problems, has improved peel resistance and when printed in an image adjacent to a white region exhibits less white overdraft.

To prepare, by way of example, about a kilogram of concentrate of the black liquid toner having a concentration of toner particles equal to about 20% by weight, about 200 grams of toner particles are mixed with about 800 grams of, optionally, Isopar L. In accordance with prior art production methods, liquid carrier Isopar L and Nucrel 699 may be premixed at an elevated temperature (e.g. 120° C.-130° C.) for about 4 hours in a double planetary mixer to provide a slurry of the carrier and Nucrel 699 polymer particles plasticized by solvation of the liquid carrier. The ingredients for producing about 200 grams of the toner ink particles comprise about 146 grams of the plasticized polymer Nucrel 699 particles, about 39 grams of Nipex 150, about 9.2 grams of Heliogen Blue 7086 (a phthalocyanine pigment), about 3.8 grams of Hostaperm Violet P-RL (a dioxazine pigment) and about 2 grams of Aluminum Tristearate, which functions as a charge adjuvant. The mixture is loaded into a one-gallon attritor manufactured by Union Process together with 3/16" carbon steel balls as grinding medium.

In accordance with an embodiment of the invention the mixture is ground in the attritor at 250 rpm for about 4 hours at a temperature of about 54°±1° C. The mixture is then cooled during a period of about 0.5 hours to a temperature of about 35°±1° C. while grinding at about 250 rpm. Grinding continues thereafter at the same rpm for an additional about 10.5 hours.

Upon completion of grinding, the mixture comprises toner ink particles having fibrous extensions and an average diameter of about 5 microns dispersed in the carrier liquid. Carrier liquid is removed from the dispersion to provide a concentrate of about 20% carrier particles. Charge director (for example, as referenced in FIG. 3 of U.S. Pat. No. 5,346,796, the disclosure of which is incorporated herein by reference) in an amount equal to about 0.3% by weight of the toner particles plus about 0.62% by weight of the carrier liquid and/or Teflon powder equal to about 3% by weight of the toner ink particles are optionally added to the ground mixture to complete preparation of the liquid toner. The Teflon powder comprises Teflon particles having an average diameter of about 3 microns and is used to improve abrasion resistance of the ink. Prior to use, the concentrate is optionally diluted to a concentration of about 1.7-2% by addition of additional carrier liquid and optionally additional charge director.

The above production procedures may be varied in accordance with prior art experience and production methods known in the art, different from those described above, may be used to produce toner in accordance with the invention.

Characteristics of a black liquid toner in accordance with an embodiment of the present invention such as a black liquid toner prepared as described in the preceding paragraph are compared in the table below to characteristics of a prior art reference black liquid toner referred to as K3.1 manufactured by Hewlett-Packard Indigo Ltd. Characteristics of a black inkjet ink described in UK Patent Application GB 2370580 cited above are also given for comparison with the inventive black liquid toner, where available and applicable. In the table characteristics of the inkjet ink and the K3.1 prior art toner are given in columns labeled "InkJet GB 580" and K3.1 respectively. A column labeled "Inventive Toner" shows the characteristics of the black liquid toner in accordance with an embodiment of the present invention. Entries for which data is non-available or non-applicable are labeled "N/A".

| Entry | Toner or Ink Characteristic | InkJet GB 580 | K3.1 | Inventive Toner |
|---|---|---|---|---|
| 1 | Colorimetry | | | |
| | L* | 21.7 | 15.75 | 14.4 |
| | a* | 0.71 | 0.27 | −0.28 |
| | b* | 2.46 | 0.87 | −0.72 |
| | C | 2.56 | 0.91 | 0.77 |
| 2 | Lightfastness: | | | |
| | Optical density (OD) fading | N/A | 22.6% | 10.3% |
| | ΔE Colorimetry change | | 11.99 | 3.9 |
| | ΔC Color neutrality change | | +3.45 | +.01 |

From entry 1 in the above table it is seen that while the inventive toner provides a printed black having a quality that is slightly better than that of the prior art reference black liquid toner K3.1 it produces a substantially better black than the reference inkjet ink. The neutrality of the inventive toner, as indicated by its C value of 0.77, is substantially better than that of the reference inkjet ink which has relatively poor C value of 2.56. For many printing applications the neutrality of the reference inkjet ink would not be satisfactory, especially considering that much more neutral toners, such as K3.1 are available. It is also noted that the high value of L* indicates a relatively lower optical density of the printed ink-jet ink.

The substantially better black provided by the inventive toner relative to the inkjet ink is surprising in view of the fact that both the inventive toner and the inkjet ink comprise a combination of the same colorants viz., carbon black, blue pigment and violet pigment. The surprising result, while not completely understood, is believed to be a result of interaction between the polymer and the pigments in the inventive toner particles, on the perceived black color resulting when the toner is used in printing.

Entry 2 shows change, i.e. fading, in optical density (OD) and change in CIELAB L*a*b* colorimetry values for a region of a substrate printed with the reference liquid toner and a substrate region printed with the inventive liquid toner caused by exposure of the regions to light. The light had a spectrum of wavelengths from about 270 to about 800 nanometers and the regions were exposed to the light for a period of about 216 hours. A parameter ΔE was used as a measure of change in L*a*b* values. ΔE for a printed ink is defined by an equation $\Delta E=[(L_f^*-L_i^*)^2+(a_f^*-a_i^*)^2+(b_f-b_i^*)^2]^{1/2}$, where $L_i^*$, $a_i^*$, $b_i^*$ and $L_f^*$, $a_f^*$, $b_f^*$ are the L*a*b* colorimetry values for the printed ink at the end and beginning of the exposure period. ΔC is defined as $C_f$-$C_i$.

OD was measured using an X-rite spectrodensitometer 938 and ΔE was measured using an X-rite spectrophotometer 968. The reference black exhibited OD fading of about 22.6% while the inventive ink exhibited OD fading of about 10.3%. AE for the reference toner was about 12 while ΔE for the inventive toner was about 3.9. Color neutrality for the inventive toner remained low and practically unchanged, while C for the K3.1 ink deteriorated substantially. These values indicate that the inventive toner as substantially better light fastness than the prior art reference toner K3.1.

The improved light fastness and printed black of an embodiment of the inventive liquid toner is a result of the better light fastness of the pigments used to offset the non-zero hue of Nipex 150. However, the present inventors have found that the major problem in color neutrality is caused by the pigments and not the carbon black. In general, by using a carbon black and a plurality of colored pigments to offset non-zero hue in the carbon black it is possible to choose the carbon black and pigments to provide a black liquid toner characterized by an improved printed black, improved fade resistance and color neutrality fastness. The extra degree of freedom provided by using more than one color offsetting pigment allows for freedom to choose more light fast pigments.

Whereas in the above description black liquid toner in accordance with the invention is produced using a particular combination of a carbon black and two pigments, other combinations of a light fast carbon black and at least two fade resistant "balancing" pigments may be used in the practice of the invention. For example, other carbon blacks suitable for the practice of the present invention are Nipex 60, Nipex 90, Nipex 160, Nipex 170, Nipex 180, Monarch 800, Monarch 900, Monarch 1100, Monarch 1200, Monarch 1300, Mogul L. In general, the mix of colored pigments used will depend on the color of the carbon black used In addition to Heliogen Blue 7086, in general, blue pigments having color index "PB 15:3" or "PB 15:4", such as Hostaperm blue b2g-d, Hostaperm blue b2g, Hostaperm blue b2g-l, Hostaperm blue bfl, Hosteperm b4g, Monstral blue bg, Monstral blue 4g may be suitable for mixing with a carbon black and purple pigment in accordance with the invention. Violet pigments other than Hostaperm Violet P-RL that have a color index PV 23, such as Hostaperm violet b1, Hostaperm violet r1-02, Hostaperm violet r1 spec may be a suitable violet pigment for the practice of the invention. Furthermore, polymers, ionomers and copolymers other than Nucrel 699, may be used to produce a toner in accordance with the invention. Such polymers for producing liquid toner are well known in the art.

To determine an appropriate combination of a given light fast carbon black and balancing pigments, the non-neutral hue of the carbon black is determined and at least two balancing pigments are chosen to neutralize the hue. A batch of liquid toner is produced from appropriate quantities of the carbon black and balancing pigments using any suitable manufacturing procedure and the color of the resultant toner determined. Amounts of the carbon black and balancing pigments are adjusted and/or other balancing pigments added as required to improve neutrality of the pigment until a satisfactory result is obtained.

In general, substantially lightfast pigment groups include Benzimidazolone pigments commercially available in various hues of the colors Yellow, Orange, and Red; Isoindolinone and Isoindoline pigments commercially available in various hues of the colors Yellow, Orange, Brown and Red; Phthalocyanine pigments commercially available in various hues of Blue and Green; Perylene and Perinone pigments commercially available in various shades of Orange 20 and Red; Diketopyrolo pyrrole (DPP) pigments commercially available in shades of Orange and Red, Thioindigo pigments available in various hues of Red and Dioxazine pigments available in various hues of Violet. In some embodiments of the invention inorganic pigments, such as Iron Oxide, Lead Chromate, Chromium Oxide, Ultramarine, and many others.

It should be understood that not all of these pigments are equally colorfast and that the choice of which pigments to use will be based on the color of the carbon black, the available colors of the pigments, the relative lightfastness of the pigments, the effect of the polymer on the actual colors achieved and the degree of neutrality to be achieved. Using three, four or more pigments allows for a greater degree of flexibility in producing a lightfast, neutral black toner.

Optionally, the mix of carbon black and balancing pigments provide liquid toner having a C value whose magnitude is less than about 2. Optionally, the C magnitude is less than about 1.5. Optionally, the C value is less than about 1.

In an embodiment of the invention, the toner produced in accordance with the invention is used in an electrographic printing process. Such processes generally include forming a charged pattern on a surface, the pattern defining image and background regions, adhering the toner particles to the image regions, transferring the adhered toner to a substrate and fusing and fixing the toner to the substrate. The present invention is believed to be applicable to a wide range of such methods, which are well known in the art and therefore do not require any detailed discussion here. In particular, when used in a liquid toner, the particles of the invention can be used in the liquid toner electrophotographic printers of Hewlett-Packard Indigo.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. For example, it is believed that relatively light fast black powder toners having improved color neutrality may be provided using combinations of a light fast carbon black and at least two balancing pigments similarly to the manner in which liquid toner are provided in accordance with the present invention. The scope of the invention is limited only by the following claims.

The invention claimed is:

1. A black liquid toner comprising a combination of:

a carrier liquid;

a slurry of plasticized polymer particles solvated with the carrier;

carbon black having a non-zero hue;

a light fast, blue pigment having a color index pigment blue 15:3 or 15:4; and a violet pigment having a color index pigment violet 23;

wherein the polymer, carbon black, blue pigment, and violet pigment are configured to provide the toner with a Chroma value having a magnitude less than about 1, after printing on white paper.

2. The black liquid toner according to claim 1 wherein the blue pigment and violet pigment are configured so that a region printed on a substrate with the toner exhibits an optical density fading of 10.3% when exposed to a light having a spectrum of wavelengths from about 270 to about 800 nanometers for a period of about 216 hours.

3. A black liquid toner comprising:

a carrier liquid;

a copolymer of ethylene and methacrylic acid;

carbon black; and a plurality of different colored balancing pigments, wherein one of the colored pigments is a blue Phthalocyanine pigment and one other of the colored pigments is a violet Dioxazine pigment;

wherein the carbon black and the plurality of different colored pigments are dispersed in the polymer; and wherein the carbon black and different colored pigments provide the toner particle with a Chroma value having a magnitude less than about 2, after printing on white paper.

4. A black liquid toner according to claim 3 wherein an image printed on white paper using the toner exhibits a Chroma value practically unchanged when exposed to a light having a spectrum of wavelengths from about 270 to about 800 nanometers for a period of about 216 hours.

5. A black liquid toner according to claim 3 wherein the printing on white paper is performed in a liquid toner electrophotographic printer.

6. A black liquid toner comprising:

a carrier liquid;

a polymer;

carbon black; and a plurality of different colored pigments, wherein one of the colored pigments is a blue Phthalocyanine pigment and one other of the colored pigments is a violet Dioxazine pigment;

wherein the carbon black and the plurality of different colored pigments are dispersed in the polymer, and wherein an image formed using the toner exhibits an optical density fading of 10.3% when exposed to a light having a spectrum of wavelengths from about 270 to about 800 nanometers for a period of about 216 hours.

7. A black liquid toner for use in printing, comprising toner particles dispersed in a carrier liquid, individual particles containing:

a polymer;

carbon black; and a plurality of different colored pigments;

wherein the carbon black and the plurality of different colored pigments are dispersed in the polymer, and wherein an image formed using the printing toner exhibits an optical density fading of about 10.3% when exposed to a light having a spectrum of wavelengths from about 270 to about 800 nanometers for a period of about 216 hours.

8. The black liquid toner according to claim 7 wherein the plurality of colored pigments comprises two colored pigments.

9. The black liquid toner according to claim 7 wherein the plurality of colored pigments comprises three or more colored pigments.

10. The black liquid toner according to claim 7 wherein one of the colored pigments is a blue pigment.

11. The black liquid toner according to claim 10 wherein the blue pigment has a color index pigment blue 15:3.

12. The black liquid toner according to claim 10 wherein the blue pigment has a color index pigment blue 15:4.

13. The black liquid toner according to claim 12 wherein the blue pigment is a Phthalocyanine pigment.

14. The black liquid toner according to claim 7 wherein one of the colored pigments is a violet pigment.

15. The black liquid toner according to claim 14 wherein the violet pigment has a color index pigment violet 23.

16. The black liquid toner according to claim 14 wherein the violet pigment is a Dioxazine pigment.

17. The black liquid toner according to claim 7 wherein the carbon black and different colored pigments provide the toner particle with a Chroma value having magnitude less than about 2, after printing on white paper.

18. The black liquid toner according to claim 7 wherein the carbon black and different colored pigments provide the toner particle with a Chroma value having magnitude less than about 1.5, after printing on white paper.

19. The black liquid toner according to claim 7 wherein the carbon black and different colored pigments provide the toner particle with a Chroma value having magnitude less than about 1, after printing on white paper, and wherein the image exhibits a change in the Chroma value of about +0.01 when exposed to the light for the period.

20. The black liquid toner according to claim 7 wherein the polymer is a copolymer of ethylene and methacrylic acid.

21. The black liquid toner according to claim 7 wherein the plurality of pigments are selected from pigment groups consisting of Benzimidazolone, Isoindolinone, Isoindoline, Phthalocyanine, Perylene, Perinone, Diketopyrolo pyrrole (DPP), Thioindigo, Dioxazine, Iron Oxide, Lead Chromate, Chromium Oxide, and Ultramarine.

* * * * *

UNITED STATES PATENT AND TRADEMARK OFFICE

CERTIFICATE OF CORRECTION

PATENT NO. : 8,338,068 B2
APPLICATION NO. : 10/575293
DATED : December 25, 2012
INVENTOR(S) : Becky Bossidan et al.

It is certified that error appears in the above-identified patent and that said Letters Patent is hereby corrected as shown below:

In the Claims:

In column 8, line 36, in Claim 18, delete “claim 7” and insert -- claim 17 --, therefor.

In column 8, line 51, in Claim 21, delete “Diketopyrolo” and insert -- Diketopyrrolo --, therefor.

Signed and Sealed this
Thirteenth Day of August, 2013

Teresa Stanek Rea
*Acting Director of the United States Patent and Trademark Office*